US009033488B2

(12) United States Patent
Erickson et al.

(10) Patent No.: US 9,033,488 B2
(45) Date of Patent: May 19, 2015

(54) EASY LOAD PRINTER MEDIA SPINDLE

(71) Applicant: Cobra Systems, Inc., Anaheim, CA (US)

(72) Inventors: Matthew Raymond Erickson, Anaheim, CA (US); Douglas J. Sproal, Anaheim, CA (US)

(73) Assignee: COBRA SYSTEMS, INC., Anaheim, CA (US)

( * ) Notice: Subject to any disclaimer, the term of this patent is extended or adjusted under 35 U.S.C. 154(b) by 0 days.

(21) Appl. No.: 14/053,548

(22) Filed: Oct. 14, 2013

(65) Prior Publication Data

US 2015/0103130 A1 Apr. 16, 2015

(51) Int. Cl.
*B41J 2/01* (2006.01)
*B41J 15/02* (2006.01)

(52) U.S. Cl.
CPC ..... *B41J 15/02* (2013.01)

(58) Field of Classification Search
CPC ..... B41J 11/0025; B41J 11/003; B41J 15/00; B41J 15/02; B41J 15/04; B41J 15/042; B41J 15/044; B41J 15/16
See application file for complete search history.

(56) References Cited

U.S. PATENT DOCUMENTS

| | | | | |
|---|---|---|---|---|
| 2,694,534 | A * | 11/1954 | Stingle et al. | 242/609.4 |
| 6,315,235 | B1 * | 11/2001 | Breyer et al. | 242/422.4 |
| 2011/0229241 | A1 * | 9/2011 | Takahashi | 400/611 |

* cited by examiner

*Primary Examiner* — Geoffrey Mruk
(74) *Attorney, Agent, or Firm* — Sheppard Mullin Richter & Hampton LLP

(57) ABSTRACT

An easy load media holder for label printers is configured to adapt to varying media widths and varying label printer types. The easy load media holder can comprise an inner spindle and at least two spindle walls, wherein the spindle walls can be positioned in varying positions along the inner spindle to securely center media of varying widths on the inner spindle.

11 Claims, 6 Drawing Sheets

EASY LOAD PRINTER MEDIA SPINDLE

FIELD OF THE INVENTION

The present invention relates generally to signage, and more particularly to easy load printer media spindles for automatic label and sign makers.

BACKGROUND OF THE INVENTION

Before automated sign makers, permanent adhesive labels and signs were created and printed by either a print/sign shop or by connecting a label printer to a personal computer that employed a design software application and printer drivers which are specific to the PC operating system. Print/sign shops are expensive, have long leads that can take three to ten business days, and often require large minimum orders. PC connected printer devices are difficult to use and have multiple software, firmware, and hardware points of failure. The only other portable standalone printing devices can print up to a maximum 2-inch wide labels and signs which cannot be used for many applications that require larger text, symbols, and sizing such as pipe marking and OSHA/ANSI safety signs.

Currently available sign makers, and specifically, center justified thermal transfer printers for continuous tape or die cut labels, only operate properly if their media is properly loaded and centered. Existing drop in spindles are expensive and increase the product cost. Slide on spindles are prone to error in centering the media, leading to frequent off-set prints and printing errors. Further, existing media spindles also limit the length of the media creating shorter length rolls, leading to more frequent reloading.

BRIEF SUMMARY OF EMBODIMENTS OF THE INVENTION

Embodiments of the present invention address the problems in the prior art by providing an easy load printer media spindle allowing both precise centering of the printer media on the spindle and adaptability to different media sizes.

Some embodiments are directed toward an easy load printer media spindle. In particular, in one embodiment of the invention, a printer media holder comprises an inner spindle and at least two spindle walls; wherein a first spindle wall is snap fit on a first end of the inner spindle in a first location, a media roll mounts on the inner spindle such that a first side of the media roll contacts the spindle wall, and a second spindle wall is snap fit on a second end of the inner spindle in a second location such that the second spindle wall contacts a second side of the media roll and secures the media roll laterally in place on the inner spindle, allowing the roll to freely rotate around the inner spindle. In this embodiment, the spindle walls can mount in multiple locations along the inner spindle, enabling the media holder to securely center varying sizes of media rolls.

In another embodiment of the invention, two parallel vertical tabs are molded on each side of the inner spindle, enabling the inner spindle to securely fit into parallel vertical receiving slots on printer cavity mounts bonded to an inner cavity of a label printer. In other embodiments of the invention, an inner adapter with notched ends fits in the center of the inner spindle such that its notched ends protrude from either side of the inner adapter, enabling mounting of the media holder on legacy label printers which are configured to accept media holders with only one notched tab on each end.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention.

These figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

Embodiments of the present invention are directed toward an easy load printer media holder. According to some embodiments of the invention, the media holder comprises an inner spindle and at least two spindle walls wherein the spindle walls are snap fit in place on the inner spindle, securing a media roll laterally in place but allowing rotation of the media roll around the inner spindle.

Figure 1:
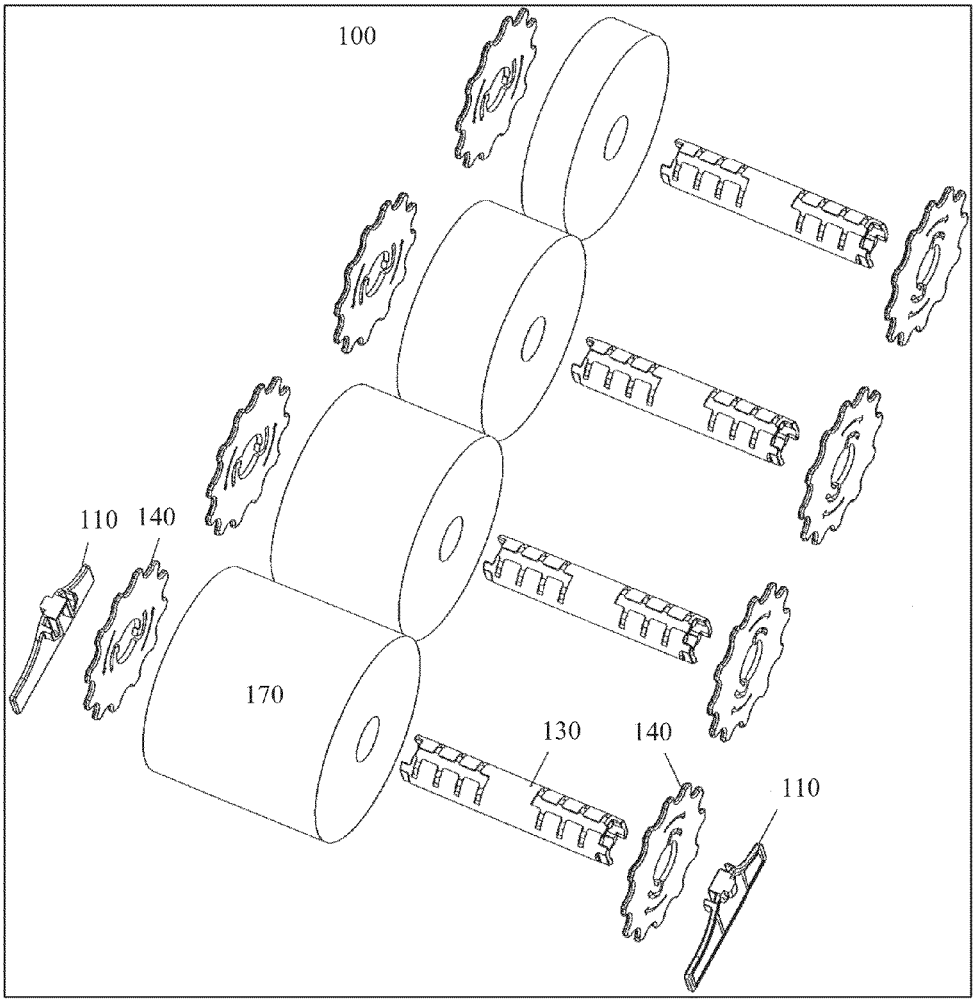
FIG. 1 is an exploded view diagram depicting one embodiment of an easy load printer media holder.

FIG. 1 illustrates an exploded view of an easy load printer media spindle in accordance with an embodiment of the invention. Referring now to FIG. 1, a media holder 100 comprises a pair of printer cavity mounts 110, an inner spindle 130, a pair of spindle walls 140, and a media roll 170. In this exemplary embodiment, the outer diameter of inner spindle 130 is approximately the same size, but slightly smaller, as the inner diameter of the media roll 170 such that the inner spindle fits snugly inside the media roll.

Figure 2:
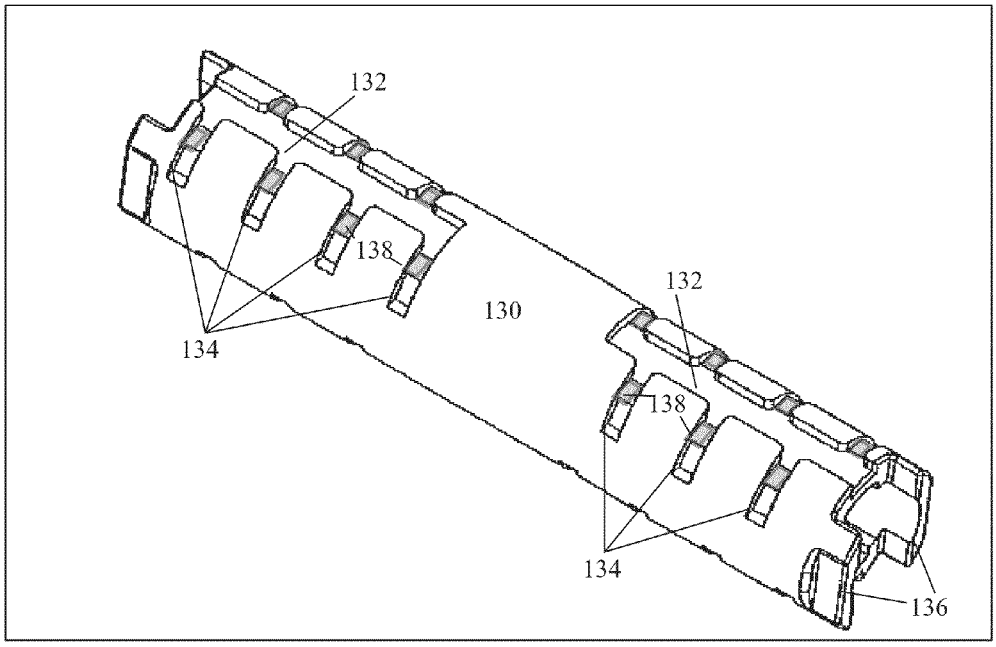
FIG. 2 is a perspective view diagram depicting an inner spindle of the easy load printer media holder.

FIG. 2 illustrates a perspective view of an inner spindle 130. Referring now to FIG. 2, the inner spindle 130 is molded in a cylindrical shape and is longer than the widest media roll accommodated by standard label makers. Notably, in this embodiment of the invention, the inner spindle accommodates media rolls with different widths. In one possible embodiment, the inner spindle can accommodate media rolls with widths of 1", 1.5", 2", 2.5", 3", 3.5", and 4". Two or more slots 132 are notched into the outside of the inner spindle structure such that each slot 132 extend laterally inward from each edge, but does not reach the center. A plurality of slots 134 are also notched into the outside of the inner spindle such that each slot 134 extends circumferentially from one of the lateral slots 132 partially around the outer circumference of the inner spindle, and such that the plurality of slots 134 is spaced across the entire length of each slot 132. A ramped dimple 138 partially separates each circumferential slot 134 from its adjacent lateral slot 132 such that a deeper well is created on one side of the slot 134 designed to accept a similarly shaped tab. Further, the edge of dimple 138 immediately adjacent to slot 132 is gently sloped, whereas the edge of dimple 138 opposite of slot 132 is completely vertical, such that if a tab slides circumferentially in slot 134 starting from slot 132 and passing over ramped dimple 138, it will fall over the vertical edge of dimple 138 and into the deep well of slot 134, locking the tab in place.

Figure 3:
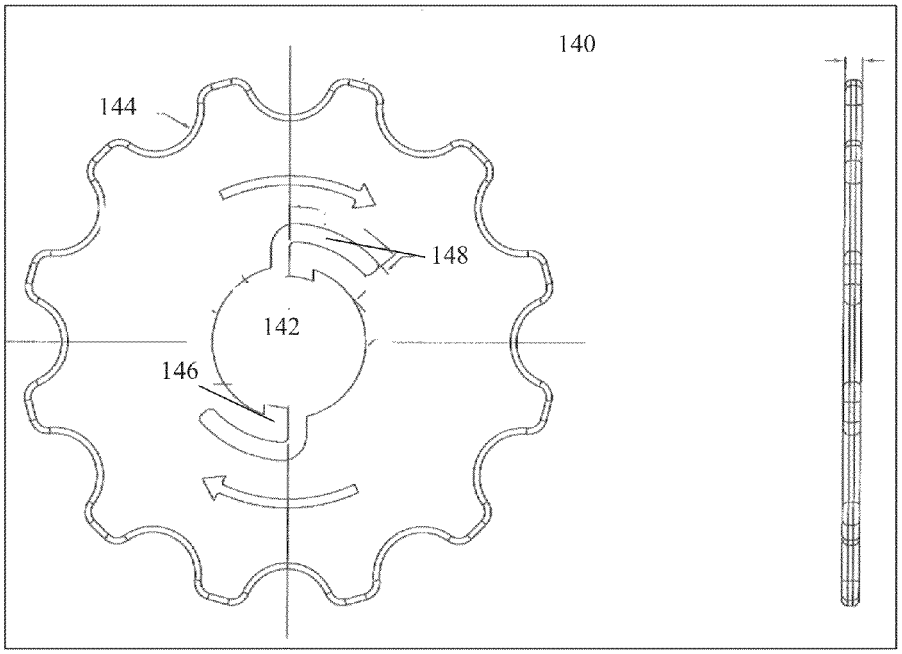
FIG. 3 is a diagram depicting a side view and an edge view of a spindle wall of the easy load printer media holder.

FIG. 3 is an illustration depicting a side view of the spindle walls 140 of the easy load printer media spindle depicted in FIG. 1. Referring now to FIG. 3, each spindle wall 140 is molded into a flattened disk shape with an inner circular centered cutout 142. The spindle wall's outer circumferential edge comprises a plurality of evenly spaced sprockets 144. The circumference of the spindle wall's circular centered cutout is approximately the same diameter as the outer diameter of the inner spindle such that the inner spindle fits snuggly inside of the circular centered cutout 142 of spindle walls 140. Further, spindle wall 140 is approximately the same width as the circumferential slots 134. In addition, one or more tabs 146 extend radially inward from the inner circumferential edge of the spindle wall, such that each of the one or more tabs 146 aligns with and fits inside one of the lateral slots 132 when the spindle wall is fit onto the inner spindle. The inner spindle then can slide laterally inward along the inner spindle with tabs 146 sliding inside slots 132. In addition, a notch 148 is cutout of the spindle wall starting immediately adjacent to each notch 146. Each cutout notch 148 extends radially outward starting at the spindle wall's inner circumferential edge for a short distance, and then turns sharply such that the cutout notch continues to run circumferentially. The cutout notches 148 enable tabs 146 to bend radially outward when radial force is applied, and then spring back into place when the force is removed.

Figure 4:
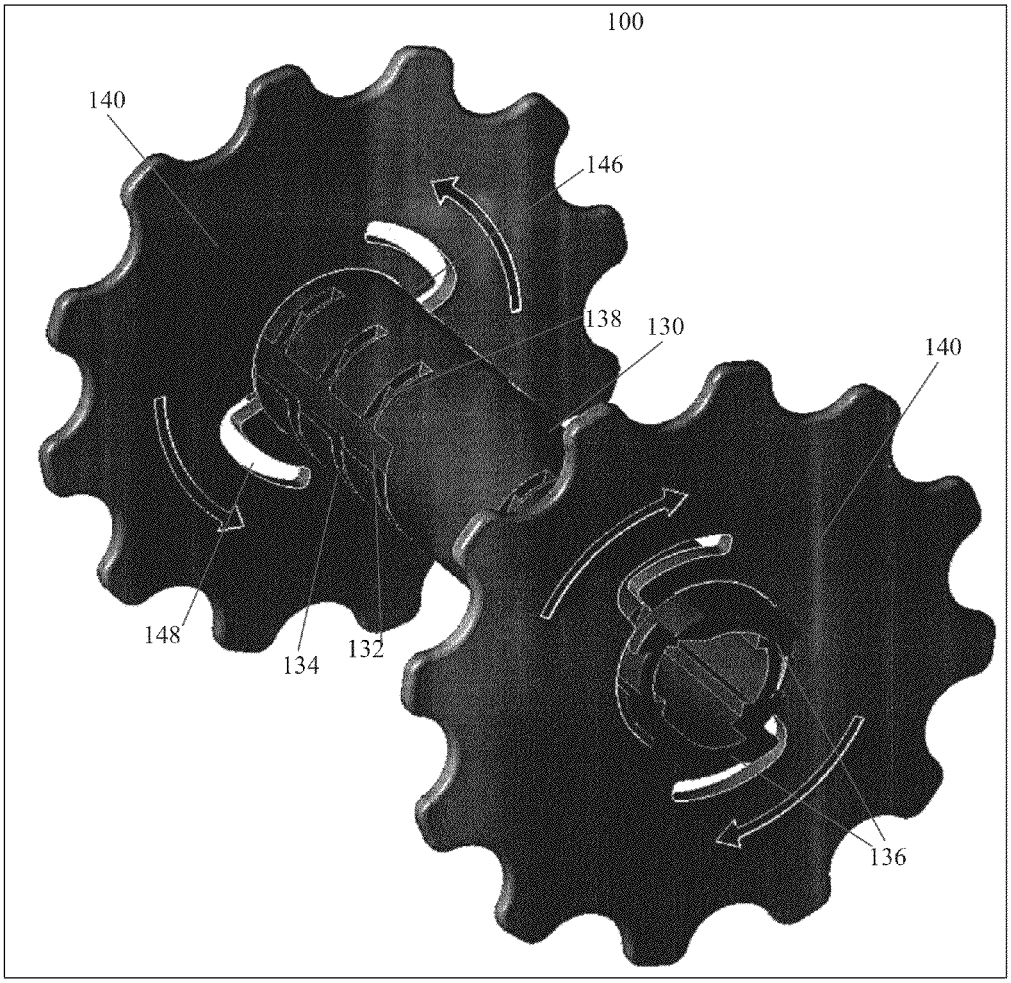
FIG. 4 is a perspective view diagram depicting an assembled embodiment of the easy load printer media holder.

FIG. 4 is an illustration depicting a perspective view of an exemplary embodiment of assembled media holder. The exemplary view of FIG. 4 is depicted without a media roll for illustrative purposes, but under normal operation of the invention, a media roll would be fit over the inner spindle 130 between spindle walls 140. Referring now to FIG. 4, to assemble the media holder assembly, a first spindle wall 140 is fit onto a first end of the inner spindle 130 such that each tab 146 aligns with and slides inside each 132 until the spindle wall reaches a desired position on the inner spindle appropriate for the desired media roll width being used. Next, the spindle wall is rotated such that each tab 146 slides in an adjacent slot 134, causing outward radial pressure and bending each tab 146 radially outward as it slides over dimple 138, until the tab 146 completely clears the vertical edge of dimple 138 and snaps radially inward. The slots 134 and tabs 146 are configured such that each tab 146 snaps into place at the same time, creating a snap-fit assembly of the spindle wall 140 on the inner spindle 130. Next, a media roll is fit over a second end of the inner spindle and slid into place touching the first spindle wall 140. Finally, a second spindle wall is fit onto the second end of the inner spindle using the same process described above.

Figure 5:
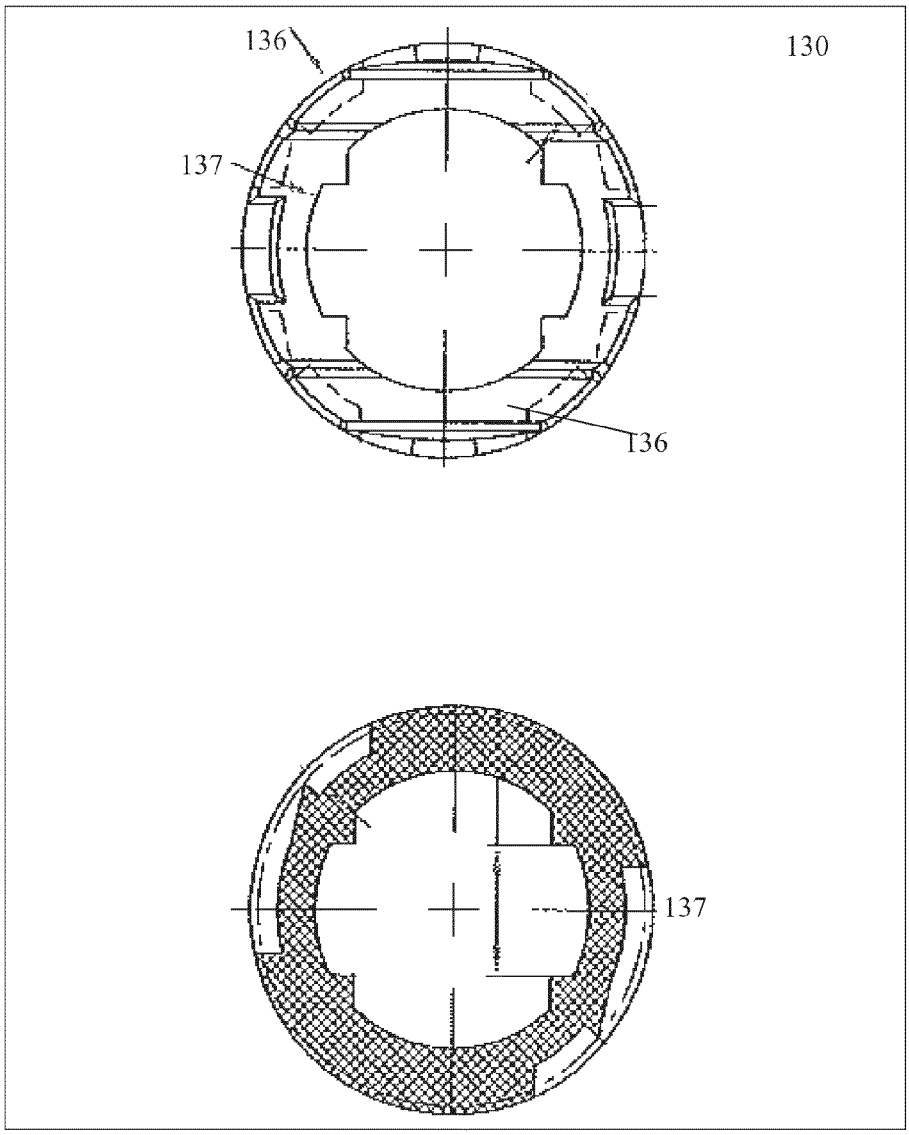
FIG. 5 is a cross-section view diagram depicting an inner spindle of the easy load printer media holder.

FIG. 5 is an illustration depicting a cross-section view of the inner spindle. Referring now to FIG. 5, and also to FIG. 2, two parallel vertical flat tabs 136 protrude from each end of inner spindle 130. Inner spindle 130 is hollow, and two pairs of notches 137 run lengthwise along the inside circumferential walls of the inner spindle structure in accordance with FIG. 5.

Figure 6:
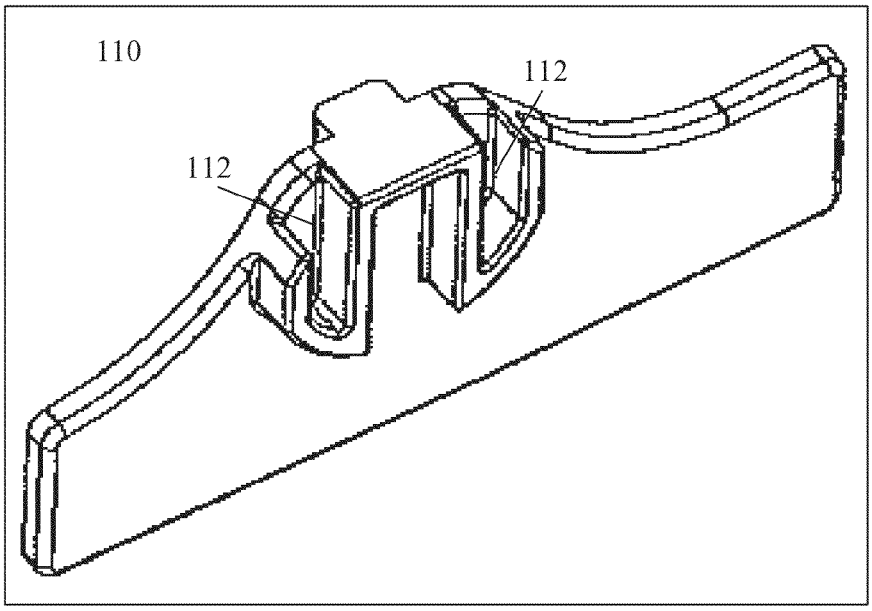
FIG. 6 is a perspective view diagram depicting a printer cavity mount of the easy load printer media holder.

FIG. 6 illustrates a perspective view of a printer cavity mount applicable to one exemplary embodiment of the invention. Referring now to FIG. 6, the printer cavity mount 110 is molded with two parallel notches 112. Two such printer cavity mounts 110 can be bonded to the inner cavity of a label printer such that a media holder can be gravity fit into the printer, resting on the printer cavity mounts. When the media holder is gravity fit on the printer cavity mounts, the parallel vertical tabs 136 on each end of the inner spindle 130 fit snuggly inside notches 112, securing the media holder in place.

Figure 7:
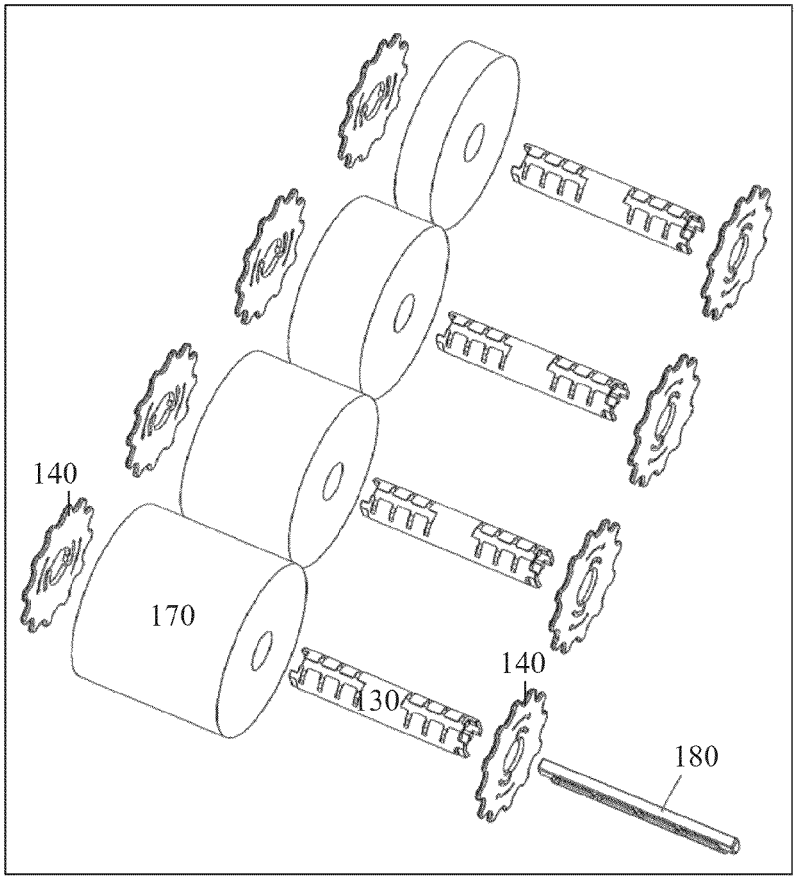
FIG. 7 is an exploded view diagram depicting the media holder depicted in FIG. 1 further comprising an inner adapter.

FIG. 7 illustrates an exploded view of another exemplary embodiment of the invention. In the illustrated embodiment, a media holder 100 comprises an inner spindle 130, a pair of spindle walls 140, an inner adapter 180, and a media roll 170. The features of this embodiment are similar to the embodiments described in FIGS. 1 through 5. However, in this embodiment, inner adapter 180 is fit through the center of inner spindle 130, fitting snuggly inside notches 112. Inner adapter 180 is slightly longer than inner spindle 130 such that notched tabs 182 protrude from either end of the media holder assembly when the inner adapter is in place.

Figure 8:
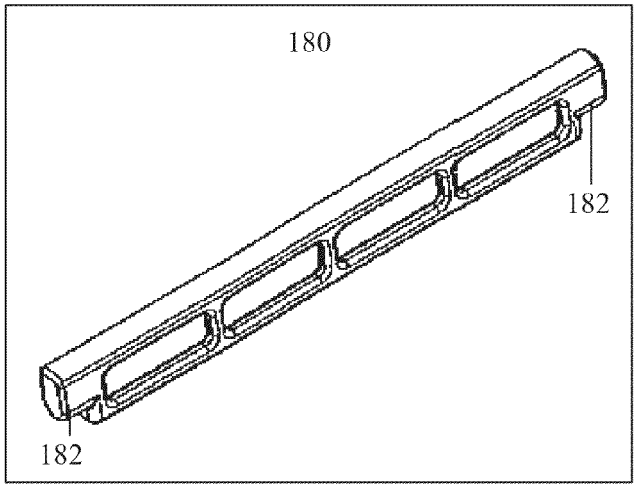
FIG. 8 is a diagram depicting a perspective view of the inner adapter of the easy load printer media holder of FIG. 7.
Figure 9:
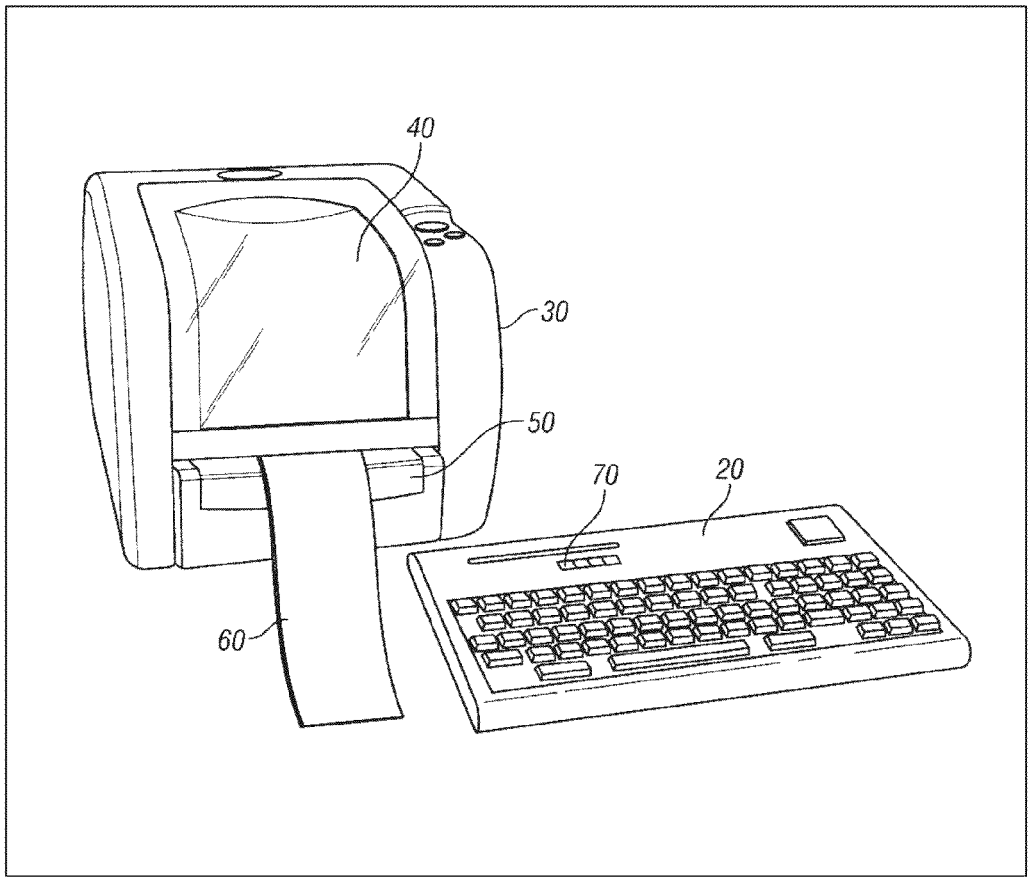
FIG. 9 is a diagram depicting a label maker printer.

FIG. 8 illustrates a perspective view of inner adapter 180. Referring to FIG. 8, the inner adapter 180 is a rectangular box shape with notched tabs 182 on each end. The top and bottom edges of the inner adapter 180, as well as the top and bottom edges of each of the notched tabs 182 are curved. When the inner adapter is inserted into inner spindle 130, notched tabs 182 protrude from either end of the inner spindle 130. The resulting assembly can then be fit inside traditional label printers designed to accept media holders with only single notched tabs, as opposed to pairs of parallel tabs as described in other embodiments of this invention.

In some embodiments of the invention, the inner spindle 130 and spindle walls 140 are molded out of plastic through an injection molding process. In other embodiments of the invention, the inner spindle 130 and/or spindle walls 140 may be molded out of metal, composite materials, or other moldable materials. Alternatively, in some embodiments of the invention, the inner spindle 130 and/or spindle walls 140 may be die cut out of plastic, metal, or composite material.

In one embodiment of the invention, each spindle wall 140 includes a lever release tab bonded to tab 146 such that, when the spindle wall 140 is snap fit in place on the inner spindle 142, pressure can be applied to the lever release tab to unseat tab 146 from slot 134. This enables the spindle wall to rotate out of its locked position so it can be removed.

In some embodiments of the invention, the spindle walls 140 may be press fit or snap fit on the inner spindle 130. In other embodiments, one or both of the spindle walls 140 may be bonded in place on inner spindle 130. Further embodiments of the invention include spring mechanism to auto-fit the spindle walls to the size of the media roll.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. A printer media holder comprising:

an inner spindle and at least two spindle walls;

wherein a first spindle wall is snap fit on a first end of the inner spindle in a first location, wherein a media roll is mounted on the inner spindle such that a first side of the media roll contacts the spindle wall, wherein a second spindle wall is snap fit on a second end of the inner spindle in a second location such that it contacts a second side of the media roll and secures the media roll laterally and centrally in place on the inner spindle, allowing the roll to freely rotate around the inner spindle, wherein two parallel flat tabs protrude from each end of the inner spindle, further comprising a first printer cavity mount and a second printer cavity mount, wherein each printer cavity mount is bonded to a media printer;

wherein the first printer cavity mount is spaced apart from the second printer cavity mount at a distance equal to a length of the inner spindle and two parallel vertical slots are notched into an inward facing side of each of the printer cavity mounts such that the two parallel flat tabs on each side of the inner spindle are gravity fit into the two parallel vertical slots of each printer cavity mount when the inner spindle is positioned between the printer cavity mounts.

2. The printer media holder of claim 1, wherein the spindle walls are mounted on the inner spindle such that a distance therebetween is 1", 1.5", 2", 2.5", 3", 3.5", or 4".

3. The printer media holder of claim 2, wherein the inner spindle and the spindle walls comprise molded plastic.

4. The printer media holder of claim 2, wherein the inner spindle and the spindle walls comprise a moldable composite material.

5. The printer media holder of claim 2, wherein the inner spindle and the spindle walls comprise metal.

6. The printer media holder of claim 2, wherein the inner spindle and the spindle walls are die cut.

7. The printer media holder of claim 1, wherein the inner spindle is a cylindrical hollow tube shape with opposing lateral slots notched throughout the entire inside length of the inner spindle, and wherein the spindle walls are flat circular disk shapes with centered circular cutouts with the same diameter as the inner spindle.

8. A printer media holder comprising:

an inner spindle and at least two spindle walls;

wherein a first spindle wall is snap fit on a first end of the inner spindle in a first location, wherein a media roll is mounted on the inner spindle such that a first side of the media roll contacts the spindle wall, wherein a second spindle wall is snap fit on a second end of the inner spindle in a second location such that it contacts a second side of the media roll and secures the media roll laterally and centrally in place on the inner spindle, allowing the roll to freely rotate around the inner spindle, further comprising an inner adapter notched on each end;

wherein the inner adapter is notched on each end, is slightly longer than the inner spindle, and is shaped and dimensioned to fit inside the inner spindle between the opposing lateral slots such that the notched ends of the inner adapter protrude from each end of the inner spindle.

9. A printer media holder comprising:

an inner spindle and at least two spindle walls;

wherein a first spindle wall is snap fit on a first end of the inner spindle in a first location, wherein a media roll is mounted on the inner spindle such that a first side of the media roll contacts the spindle wall, wherein a second spindle wall is snap fit on a second end of the inner spindle in a second location such that it contacts a second side of the media roll and secures the media roll laterally and centrally in place on the inner spindle, allowing the roll to freely rotate around the inner spindle, wherein the inner spindle is a cylinder shape and the spindle walls are flat circular disk shapes with centered circular cutouts approximating the same diameter as the inner spindle;

wherein one or more lateral slots are notched into the outside of the first side of the inner spindle extending laterally inward, one or more lateral slots are notched into outside of the second side of the inner spindle extending laterally inward, a plurality of circumferential slots are notched into the outside of the inner spindle such that each slot extends circumferentially from each of the one of the one or more lateral slots on either side of the inner spindle, and a ramped dimple partially separates each circumferential slot from its adjacent lateral slot; and wherein one or more tabs extend radially inward from the inner circumferential edge of the spindle wall cutout and wherein cutout notches partially separate each of the one or more tabs from the spindle wall structure enabling the tab to bend radially outward when pressure is applied, such that: (i) each of the one or more tabs aligns with each of the one or more lateral slots when the spindle wall mounts on the inner spindle; (ii) each of the one or more tabs aligns with one of the plurality of circumferential slots if the spindle wall is positioned in one of a plurality of predetermined positions; and (iii) each of the one or more tabs snap-fits in place over the ramped dimple in one of the plurality of circumferential slots when the spindle wall is rotated.

10. The printer media holder of claim 9 wherein the circumferential slots are positioned at 0.5", 0.75", 1", 1.25", 1.5", 1.75", and 2" from the center of the inner spindle.

11. A printer media holder comprising:

an inner spindle and at least two spindle walls;

wherein a first spindle wall is snap fit on a first end of the inner spindle in a first location;

wherein a media roll is mounted on the inner spindle such that a first side of the media roll contacts the spindle wall;

wherein a second spindle wall is snap fit on a second end of the inner spindle in a second position such that it contacts a second side of the media roll and secures the media roll laterally and centrally in place on the inner spindle, allowing the roll to freely rotate around the inner spindle;

wherein the inner spindle is a cylinder shape and the spindle walls are flat circular disk shapes with centered circular cutouts approximating the same diameter as the inner spindle;

wherein one or more lateral slots are notched into the outside of the first side of the inner spindle extending laterally inward, one or more lateral slots are notched into outside of the second side of the inner spindle extending laterally inward, a plurality of circumferential slots are notched into the outside of the inner spindle such that each slot extends circumferentially from each lateral slot on either side of the inner spindle, and a ramped dimple partially separates each circumferential slot from its adjacent lateral slot; and wherein one or more tabs extend radially inward from the inner circumferential edge of the spindle wall cutout and wherein cutout notches partially separate each of the one or more tabs from the spindle wall structure enabling the tab to bend radially outward when pressure is applied, such that: (i) each of the one or more tabs aligns with each of the one or more lateral slots when the spindle wall mounts on the inner spindle; (ii) each of the one or more tabs aligns with one of the plurality of circumferential slots if the spindle wall is positioned in one of a plurality of predetermined positions; and (iii) each of the one or more tabs snap-fits in place over the ramped dimple in one of the plurality of circumferential slots when the spindle wall is rotated.

* * * * *